US007140166B2

(12) United States Patent
Cere'

(10) Patent No.: US 7,140,166 B2
(45) Date of Patent: Nov. 28, 2006

(54) APPARATUS FOR MAKING PACKAGES OF PRODUCTS WRAPPED WITH STRETCH PLASTIC FILM

(75) Inventor: Mauro Cere', Loiano (IT)

(73) Assignee: Aetna Group, S.p.A., Villa Verucchio (IT)

( * ) Notice: Subject to any disclaimer, the term of this patent is extended or adjusted under 35 U.S.C. 154(b) by 95 days.

(21) Appl. No.: 10/733,194

(22) Filed: Dec. 11, 2003

(65) Prior Publication Data

US 2004/0118086 A1 Jun. 24, 2004

(30) Foreign Application Priority Data

Dec. 18, 2002 (IT) ..... BO2002A0799

(51) Int. Cl.
*B65B 11/58* (2006.01)
*B65B 11/00* (2006.01)

(52) U.S. Cl. ..... 53/449; 53/591

(58) Field of Classification Search ..... 53/449, 53/441, 450, 176, 548, 550, 589, 590, 591, 53/210, 211
See application file for complete search history.

(56) References Cited

U.S. PATENT DOCUMENTS 2,864,212 A 12/1958 Bruce
4,514,966 A 5/1985 Konstantin
4,730,436 A 3/1988 Angelino
4,730,437 A 3/1988 Benno
2003/0024213 A1 2/2003 Cere'

FOREIGN PATENT DOCUMENTS

DE 2043312 3/1972
DE 100 21 157 10/2001
EP 1 288 127 A1 3/2003

OTHER PUBLICATIONS

European Search Report corresponding to EP Application No. EP 03 42 5784.

*Primary Examiner*—Rinaldi I. Rada
*Assistant Examiner*—John Paradiso
(74) *Attorney, Agent, or Firm*—Fay, Sharpe, Fagan, Minnich, McKee, LLP

(57) ABSTRACT

An apparatus for making packages including groups of products wrapped with stretch film includes a transporting surface for conveying groups of products in a feed direction. A first pair of film feed stations are located on opposite sides of the transporting surface, and a first selection carriage includes at least two units for forming a respective tubular length of film fed by the respective stations. The apparatus also includes means for driving the first carriage to and fro in a direction transverse to the feed direction in such manner as to cyclically perform the following operations: forming the tubular length of film on a first unit outside the transporting surface, and at the same time positioning the other unit with the respective tubular length of film on it in a stretched configuration at the transporting surface to form a part of the latter so as to enable feeding of the group of products into the tubular length of film and releasing of the tubular length of film over the group of products to form a wrapped package.

21 Claims, 4 Drawing Sheets

APPARATUS FOR MAKING PACKAGES OF PRODUCTS WRAPPED WITH STRETCH PLASTIC FILM

BACKGROUND OF THE INVENTION

The present invention relates to an apparatus for making packages of products wrapped with stretch plastic film.

In the current packaging industry, one of the uses of stretch plastic film is to wrap groups of products such as bottles with bases of different shapes—for example, circular, square or rectangular—or even containers made of metal or glass (and including parallelepiped shaped containers).

Machinery for wrapping groups of products with stretch film rather than heat shrink film or other materials has developed over the years because it has been found to be more economical to run and to have a simpler structure, while providing equally good wrapping quality.

In one prior art solution that uses stretch film, described in European patent application N.01830521.9 by the same Applicant as the present, the machine that implements a wrapping method based on stretch film essentially comprises:

- a feed table on which the groups of products presenting a front face and a longitudinal dimension are formed;
- a first station for making the packages, located on and forming part of the feed table, and being equipped with first means for unwinding the stretch film and forming a length of the stretch film wound around first means for preforming the package located on the feed table and mobile between several working positions where the tubular length of film is stretched open wide, the group of products fed into it, and the wrapped package fed back out onto the feed line once the stretch film has shrunk back to its original size.

This first station may be followed, further downstream, by a structurally similar station, preceded by a station for turning the package through ninety degrees, to wrap the package with a second tubular length of film.

A machine of this type, although reliable and fulfilling its purpose, has inherent speed limitations which make it unable to fully meet the requirements of modern packaging houses, where wrapping speed is of the utmost importance.

The present invention therefore has for an aim to provide an apparatus for making packages of products wrapped with stretch plastic film that is at once extremely flexible and capable of achieving high production speeds without reducing wrapping quality and reliability.

SUMMARY OF THE INVENTION

According to the invention, this aim is achieved by an apparatus for making packages containing groups of products wrapped with stretch film and comprising the following: a transporting surface for conveying groups of products presenting a front face in a defined feed direction; a first pair of film feed stations located on opposite sides of the transporting surface; a first selection carriage comprising at least two units for forming a respective tubular length of film fed by the respective stations, and means for driving the first carriage to and fro in a direction transversal to the feed direction in such manner as to cyclically perform the following operations: forming the tubular length of film on a first unit positioned outside the transporting surface, and at the same time positioning the other unit with the respective tubular length of film on it in a stretched configuration at the transporting surface to form a part of the latter so as to enable feeding of the group of products into the tubular length of film and releasing of the same tubular length of film over the group of products to form a wrapped package.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

Figure 1:
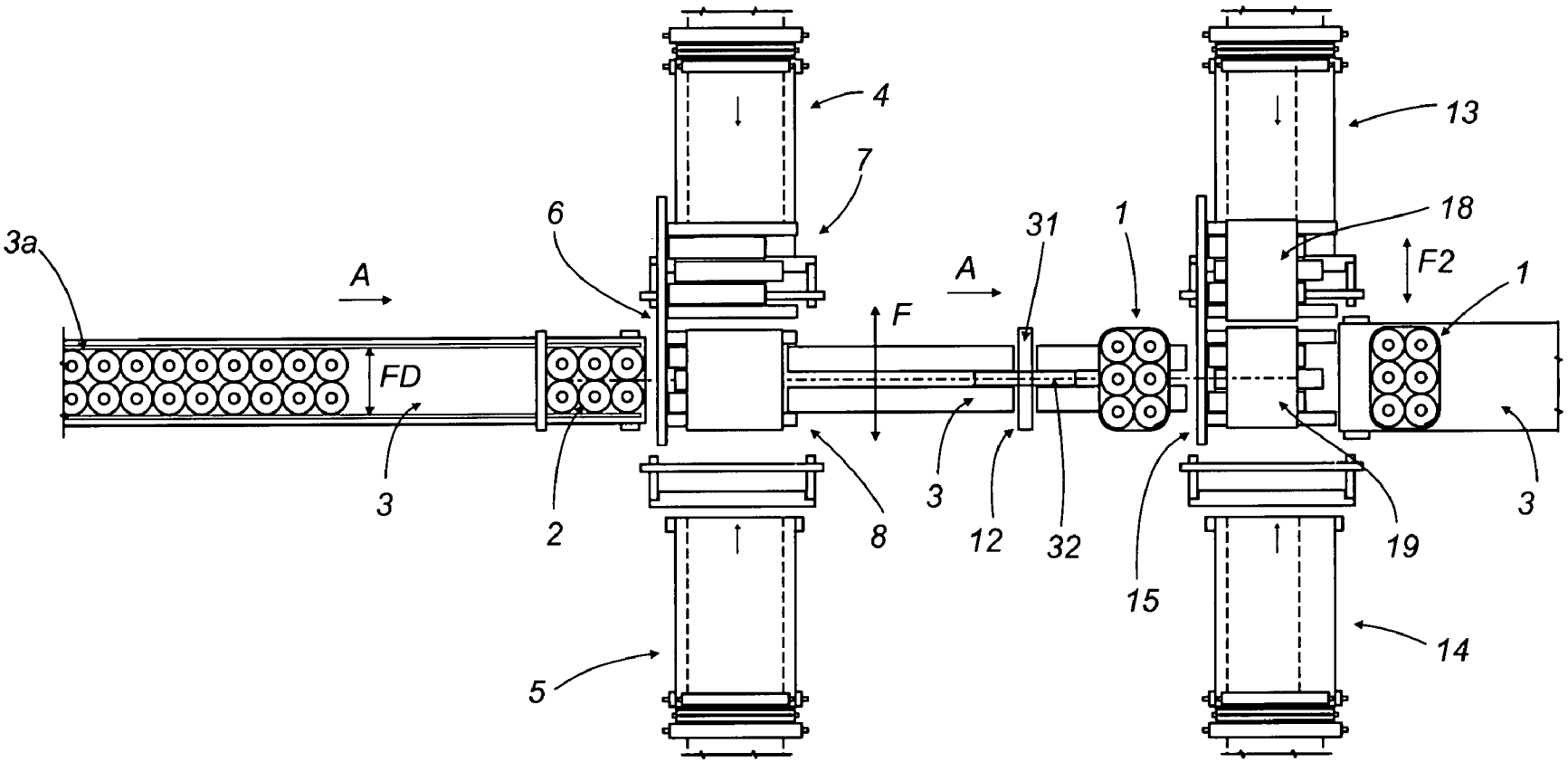
FIG. 1 is a schematic top plan view illustrating an apparatus according to the present invention for making packages containing groups of products wrapped with stretch film, during a step in the operation of the apparatus.
Figure 2:
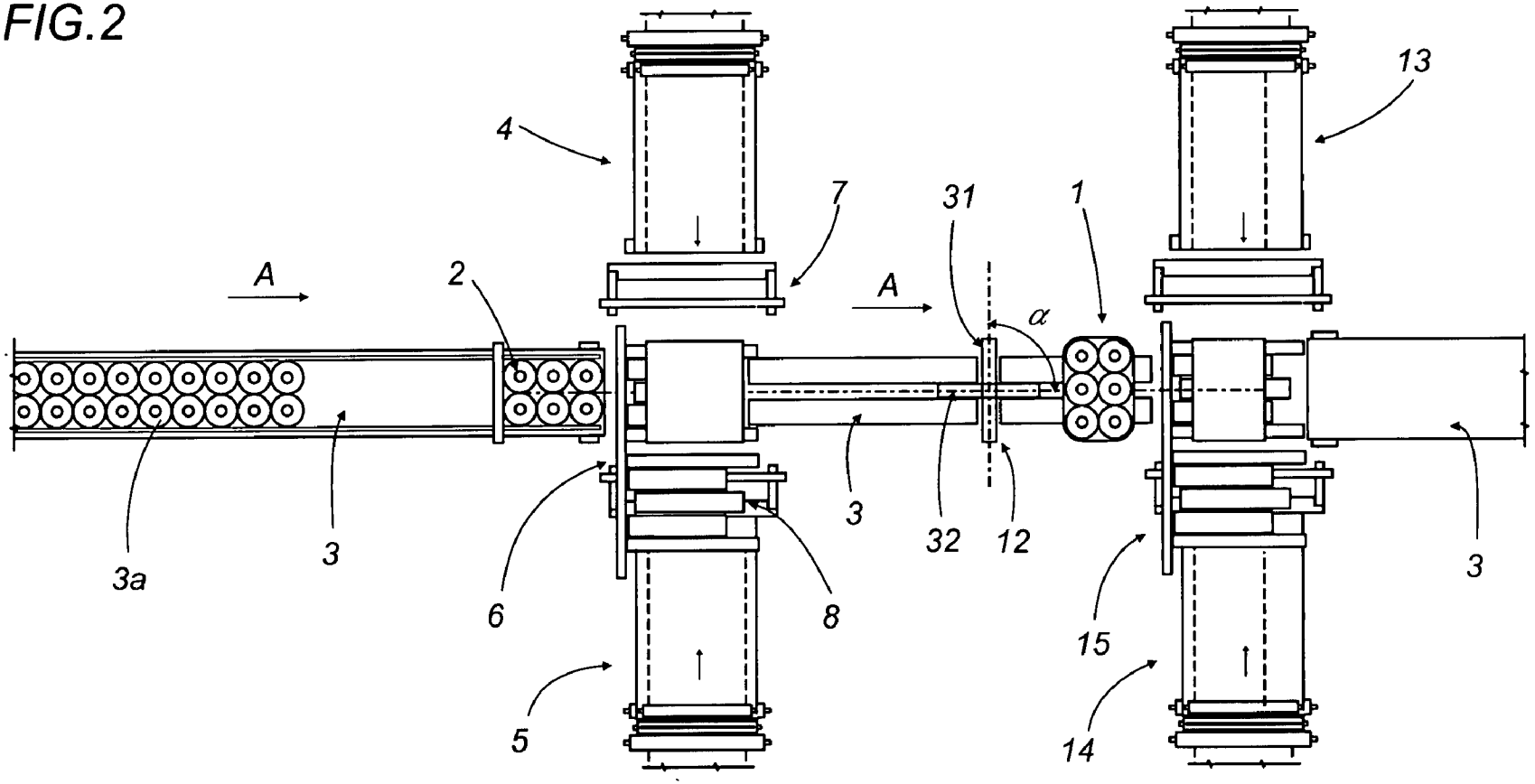
FIG. 2 is a schematic top plan view of the apparatus of FIG. 1 during another step in its operation.

With reference to the accompanying drawings, in particular FIGS. 1 and 2, the apparatus according to the invention is especially designed to make packages 1 comprising groups 2 of products wrapped with stretch film, which may be stretch plastic film.

The groups of products to be wrapped may be bottles with bases of different shapes—for example, circular, square or rectangular—or even containers made of metal or glass (including parallelepiped shaped containers), but without thereby limiting the scope of the inventive concept.

Figure 3:
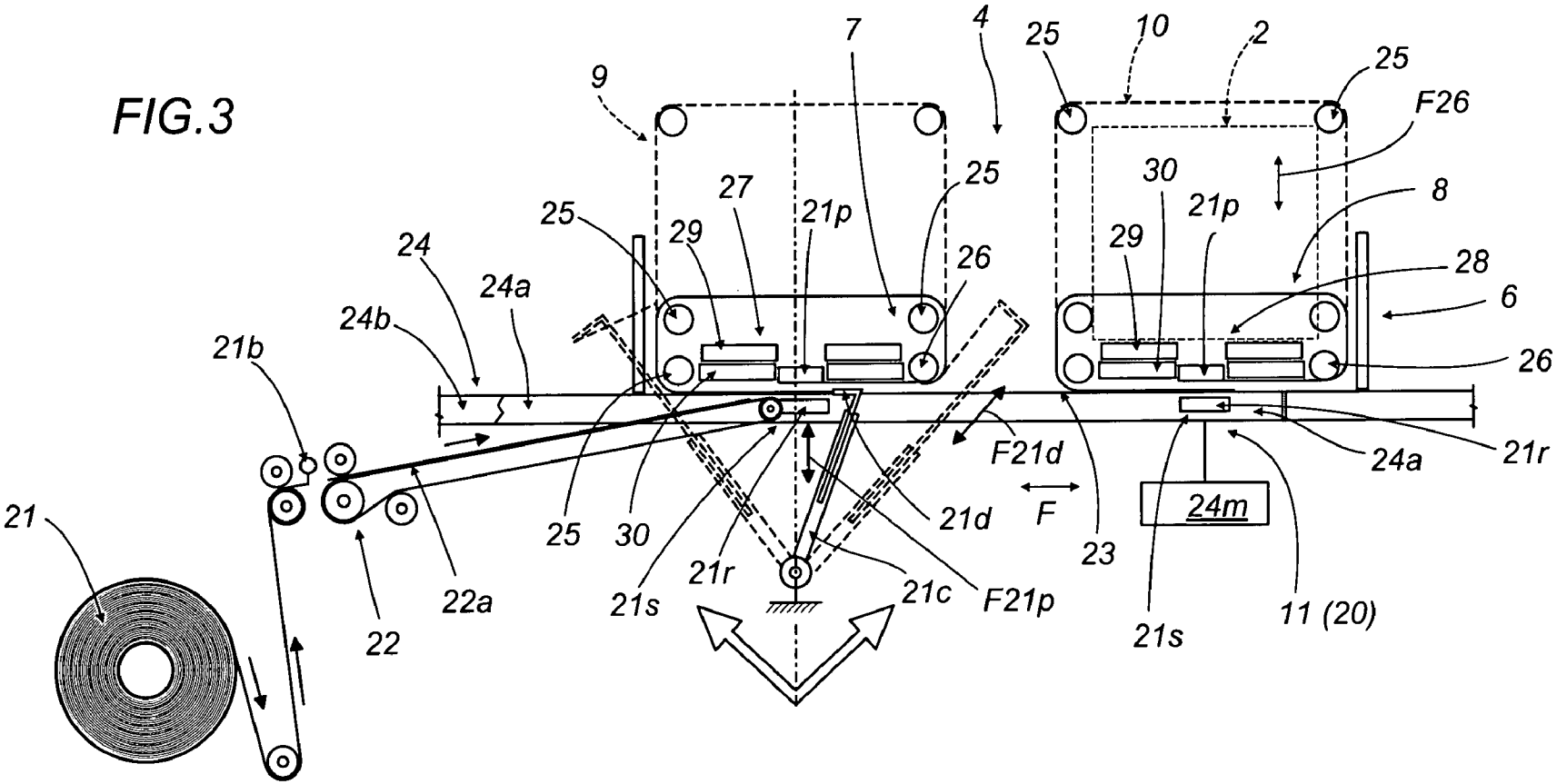
FIG. 3 is a schematic front view, with some parts cut away in order to better illustrate others, of the apparatus of FIGS. 1 and 2.

The apparatus illustrated essentially comprises:

- a transporting surface 3 for conveying the groups 2 of products (from a suitable collating channel 3*a* where the groups 2 are formed) in a feed direction A and presenting a defined front face FD;
- a first pair of film feed stations 4 and 5, located on opposite sides of the transporting surface 3;
- a first selection carriage 6 comprising at least two units 7 and 8 for forming a respective tubular length 9 and 10 of film fed by the respective stations 4 and 5, and means 11 for driving the first carriage 6 to and fro in a direction transversal to the feed direction A (see arrow F in FIG. 3).

This drive motion causes the following operations to be cyclically performed:

- forming the tubular length of film 9 on a first unit 4 outside the transporting surface 3; and at the same time,
- positioning the other unit 5 with the respective tubular length of film 10 on it in a stretched configuration at the transporting surface 3 to form a part of the latter so as to enable feeding of the group 2 of products into the tubular length of film 10 and releasing of the tubular length of film 10 over the group 2 of products to form a wrapped package 1 thanks to the elastic properties of the stretch film.

In the accompanying drawings, the apparatus also comprises, downstream of the first pair of feed stations 4 and 5 in the feed direction A and also on the transporting surface 3:

a station 12 for turning the incoming package 1 by a defined angle α as it moves from the working area of the first pair of units 7 and 8 on the transporting surface 3, the station 12 also being located on the transporting surface 3.

Downstream of the station 12, there is another working area similar to the one described above and comprising:

a second pair of film feed stations 13 and 14, located on opposite sides of the transporting surface 3;

a second selection carriage 15 comprising at least two units 16 and 17 for forming other tubular lengths 18 and 19 of film fed by the respective stations 13 and 14, and second means 20 for driving the second carriage 15 to and fro in a direction transversal to the feed direction A (see arrows F2) in such a way as to cyclically perform the following operations:

forming a third tubular length of film 18 on the third unit 16 outside the transporting surface 3; and at the same time, positioning the fourth unit 17 with the respective fourth tubular length of film 19 on it in a stretched configuration at the transporting surface 3 to form a part of the latter so as to enable feeding of the package 1 of products into the fourth tubular length of film 19 and releasing of the fourth tubular length of film 19 over the package to form a twice-wrapped package 1.

This produces packages 1 wrapped with two sheets of film placed transversally to each other over the group 2 of products (this type of wrapping being disclosed in European patent application No. 01830521.9, in the name of the same Applicant as the present).

Looking more closely at the constructional details, with reference also to FIG. 3, each film feed station 4, 5; 13, 14 comprises at least one roll 21 of stretch film and transporting means 22 for positioning a respective length of film 9, 10; 18, 19 at the respective forming unit 7, 8; 16, 17.

The structure of the stations 4, 5; 13, 14 is not illustrated in full detail since it does not strictly form part of the invention. Nevertheless, as in the embodiment of the invention being described, it may comprise the roll 21 and the means 22 consisting of a film transporting surface 22*a*, a knife 21*b*, located downstream of the roll 21, for cutting the respective film length 9, 10; 18, 19, and a telescopic arm 21*c* with a gripper 21*d* for gripping the end of the film length 9,10; 18,19.

The arm 21*d* winds the film length 9, 10; 18, 19 around the respective unit 7, 8; 16, 17 thanks to its swinging motion (indicated by the arrows F21*d* in FIG. 3) on one side of the structure defined by the carriages 6 and 15.

Provision is also made for a sealing unit 21*s* designed to join the ends of the film length 9, 10; 18, 19 and located underneath the respective unit 7, 8; 16, 17 for forming the tubular film length 9, 10; 18, 19. The sealing unit 21*s* may comprise a sealing plate 21*p* and a contact plate 21*r* that moves relative to the sealing plate 21*p* (see arrow F21*p*).

With reference to FIG. 3, each of the carriages 6, 15 comprises a mobile surface 23 for supporting the respective pair of units 7, 8; 16, 17 for forming the length 9, 10; 18, 19 and positioned at the respective end of the corresponding carriage 6, 15.

The surface 23 may be slidably mounted on at least one guide 24 (defining the drive means 11 and 20) located under the surface 23 in such a way as to enable one of the units 7, 8; 16, 17 to be moved close to the respective feed station 4, 5; 13, 14 while the other unit 7, 8; 16, 17 is positioned at the transporting surface 3, and vice versa (see FIG. 2 again).

Obviously, the guide 24 may comprise a bar 24*a* that is slidably mounted on a fixed frame 24*b* (forming part of the fixed structure of the apparatus) and is acted upon by drive means 24*m*, illustrated schematically by way of example only.

Returning to FIG. 3, each of the units 7, 8; 16, 17 for forming the respective tubular lengths of film 9, 10; 18, 19 comprises at least two pairs 25 and 26 of horizontal arms around which the respective film length 9, 10; 18, 19 is wound by the aforementioned telescopic arm 21*d*.

One pair of arms 25 may be mobile towards and away from the respective fixed arm 26 (see arrows F26 in FIG. 3) so as to stretch the respective length of film 9, 10; 18, 19 and then release the tubular film length 9, 10; 18, 19 over the respective group 2 of products (the structure of the arms 25 and 26 not falling within the scope of the present invention and therefore not being described in detail).

Still with reference to FIG. 3, each carriage 6, 15 has at least two areas 27 and 28 where the respective group 2 of products is supported and passes into the respective tubular film length 9, 10; 18, 19.

Each area 27 and 28 consists of a double plurality of superposed, counterrotating rollers 29, 30 designed to simultaneously feed out in a single feed direction A the product group 2 or package 1 and the respective film length 9, 10; 18, 19 wound around the group 2 or package 1 itself. In other terms, the rollers 29 and 30 rotate in opposite directions so as to cause the products 2 and the film length 9, 10; 18, 19 to move in the same feed direction.

The aforementioned turning station 12 comprises two feed surfaces 31 and 32 forming a cross on the transporting surface 3 so that the incoming product package 1 is stopped at a defined position and then turned by an angle α such that the package 1 is repositioned on the transporting surface 3 and is ready to be overwrapped with another sheet of film (this station also not being illustrated in detail since it does not strictly form part of the invention).

The method for making packages 1 containing groups 2 of products wrapped with stretch film comprises at least the following steps:

feeding at least one portion of film from a first film feed station 4, located outside the transporting surface 3, to a respective first unit 7 for forming a tubular length of film 9; and simultaneously positioning a second forming unit 8 with a second length of film 10 on it in a stretched configuration at the transporting surface 3 to form a part of the latter, at least through first means for supporting or carriage 6 for driving the units 7, 8;

passing a group 2 of products into the second length of film 10 and then releasing the second length of film 10 over the group 2 of products, by driving the second unit 8, in order to wrap the group 2 of products;

driving the first carriage 6 in order to move the first unit 7, with the first tubular length of film 9 formed on it, on the transporting surface 3 so as to wrap the next group 2 of products; and simultaneously moving the second unit 8 at the second film feed station 5 outside the transporting surface 3 so as to feed the next film portion onto the second unit 8.

According to the structure of the apparatus described above, the method comprises the following steps, after each releasing and wrapping step:

a step of feeding the package 1 out along the transporting surface 3 in the aforementioned feed direction A;

a step of turning the package 1 through a defined angle α;

a third step of feeding at least one third portion of film from a third film feed station 13, also located outside the transporting surface 3, to the respective third unit 16 for forming the third tubular length of film 18; and simultaneously positioning the fourth forming unit 17 with the fourth length of film 19 on it in a stretched configuration at the transporting surface 3 to form a part of the latter, at least through second means 15 for supporting or second carriage for driving the units 16 and 17;

passing the package 1 of products into the fourth length of film 19 to form the overwrapping and then releasing the fourth length of film 19 over the package 1 of products, by driving the fourth unit 17, in order to overwrap the package 1 of products;

driving the carriage 15 in order to move the third unit 16, with the third tubular length of film 18 formed on it, from the third feed station 13 to the transporting surface 3 to wrap the next package 1 of products; and simultaneously moving the fourth unit 17 at the fourth film feed station 14 outside the transporting surface 3 so as to feed the next film portion onto the fourth unit 17.

As clearly shown in FIGS. 1 and 2, each step of feeding the length of film 9, 10, 18, 19 onto the respective unit 7, 8, 16, 17 is performed in an area to the side of the transporting surface 3.

More specifically, the steps of feeding the lengths of film 9, 10; 18, 19 are performed in areas on both sides of the transporting surface 3.

Similarly, the steps of passing the units 7, 8; 16, 17 from the feed stations 4, 5; 13, 14 to the transporting surface 3 may include a step of stretching the lengths of film 9, 10; 18, 19 in such a way that the gap created for the passage of the product group 2 is larger than the latter's front face FD.

The step of stretching the length of film 9, 10; 18, 19 might also be performed before the step of passing the unit 7, 8; 16, 17 from the feed station 4, 5; 13, 14 to the transporting surface 3, or while the station is moving towards the transporting surface.

Figure 4:
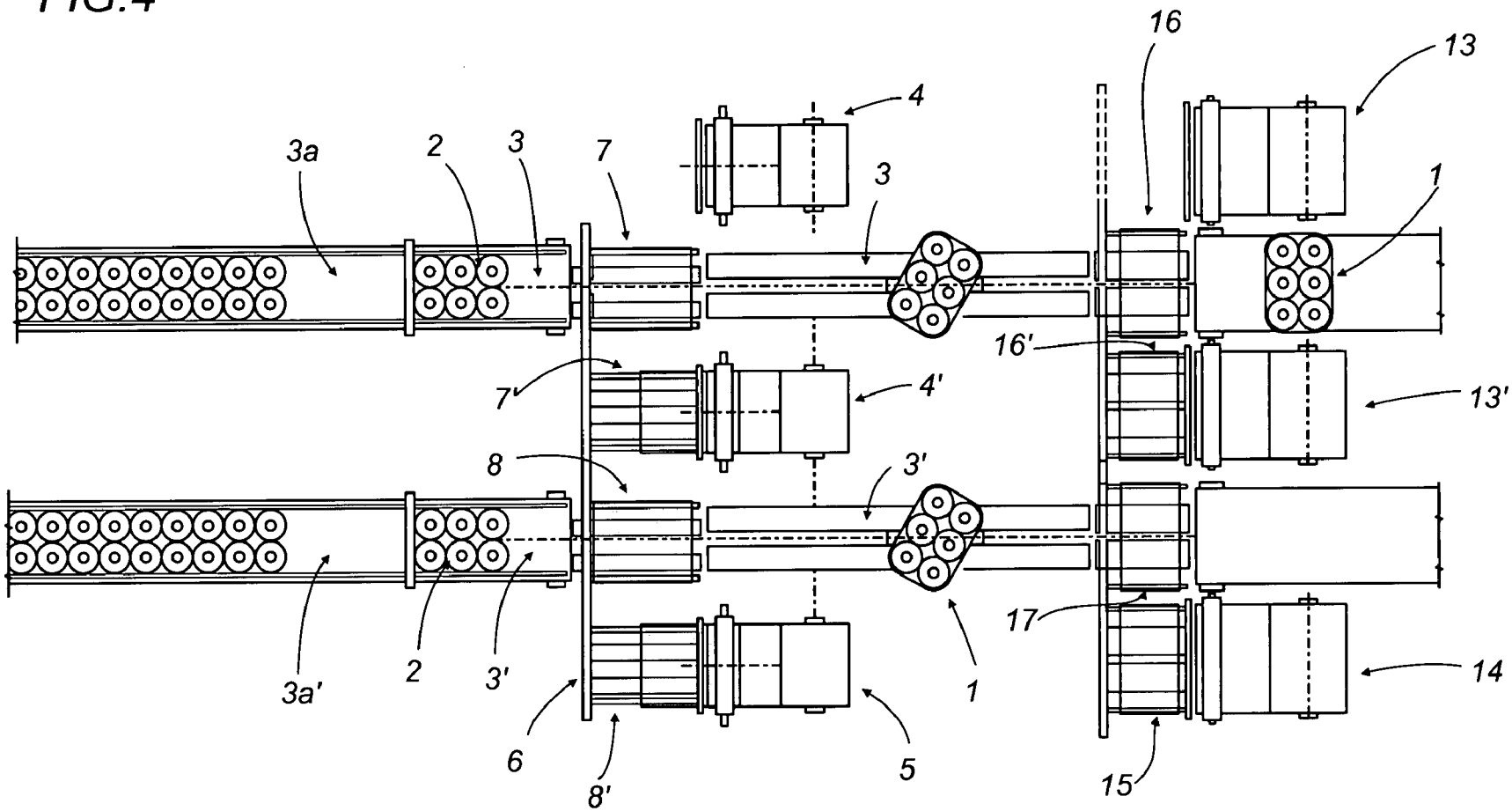
FIG. 4 is a schematic top plan view of another embodiment of the apparatus according to the invention.

As confirmation of the validity of the solution described above, FIG. 4 shows an expanded solution where there are two transporting surfaces 3 and 3' and an additional third film feed station 4', 13' shared by the two transporting surfaces 3, 3'. In this case, purely by way of example, the film feed stations work with preformed tubular lengths of film.

The two carriages 6 and 15 are equipped with a further four units 7', 8' and 16', 17' to enable simultaneous feeding to both transporting surfaces 3 and 3' and forming operations in both film feed stations at the same time.

An apparatus and method as described above achieve the aforementioned aims of the invention thanks to an extremely simple structural arrangement and succession of steps, with the addition of just a few elements.

Film feed outside the product transporting surface means that operating time is reduced to the main task of applying the film to the groups of products without waiting for the film to be formed on the respective units. In practice, the film forming steps are performed on one side of the transporting surface, in "masked time", so as not to interfere with feeding of the product groups.

This special structure is extremely flexible and adaptable to the user's requirements, that is to say, to suit any type of production line, with a variable number of transporting surfaces and for any type of product to be stretch-wrapped, since the feed stations are always mounted on both sides of the transporting surface or surfaces and the carriages are equipped with forming units according to the number of transporting surfaces. Moreover, by simply opting for different types of film feed stations, the same structure can be used with either preformed tubular film or film to be formed into tubular shape at the time of use.

The invention described has evident industrial applications and can be modified in several ways without thereby departing from the scope of the inventive concept. Moreover, all the details of the invention may be substituted by technically equivalent elements.

What is claimed is:

1. A method for making packages (1) containing groups (2) of products wrapped with stretch film, presenting a front face (FD) and moving along a transporting surface (3) in a defined feed direction (A), the method comprising at least the following steps:

feeding at least one portion of film from a first film feed station (4), located outside the transporting surface (3), to a respective first unit (7) for forming a tubular length of film (9); and simultaneously positioning a second forming unit (8) with a second length of film (10) on it in a stretched configuration at the transporting surface (3) to form a part of the latter, at least through first means (6) for driving and supporting the units (7, 8);

passing a group (2) of products into the second length of film (10) and then releasing the second length of film (10) over the group (2) of products, by driving the second unit (8), in order to wrap the group (2) of products;

driving the first means (6) in order to move the first unit (7), with the first tubular length of film (9) formed on it, on the transporting surface (3) so as to wrap the next group (2) of products; and simultaneously moving the second unit (8) from its position at the transporting surface (3) to a position outside the transporting surface (3) so as to feed the next film portion onto the second unit (8).

2. The method according to claim 1, further comprising:

after said step of passing the group (2) of products into the second length of film (10) and then releasing the second length of film (10) over the group (2) of products in order to wrap the group (2) of products, a step of feeding the package (1) out along the transporting surface (3) in the feed direction (A).

3. The method according to claim 1, further comprising, after said step of passing the group (2) of products into the second length of film (10) and then releasing the second length of film (10) over the group (2) of products in order to wrap the group (2) of products:

a step of feeding the package (1) out along the transporting surface (3) in the feed direction (A):

a step of turning the package (1) through a defined angle ($\alpha$);

a third step of feeding at least one third portion of film from a third film feed station (13), located outside the transporting surface (3), to a third unit (16) for forming a third tubular length of film (18); and simultaneously positioning a fourth forming unit (17) with a fourth length of film (19) on it in a stretched configuration at the transporting surface (3) to form a part of the latter, at least through second means (15) for driving and supporting the units (16, 17);

passing a package (1) of products into the fourth length of film (19) to form the overwrapping and then releasing the fourth length of film (19) over the package (1) of products, by driving the fourth unit (17), in order to overwrap the package (1) of products;

driving the second means (15) in order to move the third unit (16), with the third tubular length of film (18) formed on it, from the third feed station (13) to the transporting surface (3) to wrap the next package (1) of products; and simultaneously moving the fourth unit (17) at a fourth film feed station (14) outside the transporting surface (3) so as to feed the next film portion onto the fourth unit (17).

4. The method according to claim 1, wherein the steps of moving the units (7, 8; 16, 17) from the feed stations (4, 5; 13, 14) to the transporting surface (3) include a step of stretching the film lengths (9, 10; 18, 19) in such a way to define a gap larger than a front face (FD) of the product group (2) for the passage of the product group (2) into the film lengths (9, 10; 18, 19).

5. The method according to claim 1, wherein the steps of moving the units (7, 8; 16, 17) from the feed stations (4, 5; 13, 14) to the transporting surface (3) are preceded by a step of stretching the film lengths (9, 10; 18, 19) in such a way to define a gap larger than a front face (FD) of the product group (2) for the passage of the product group (2) into the film lengths (9, 10; 18, 19).

6. The method according to claim 1, wherein each step of feeding the film length (9, 10; 18, 19) onto the respective forming unit (7, 8; 16, 17) is performed in an area to the side of the transporting surface (3).

7. The method according to claim 1, wherein each step of feeding the film length (9, 10; 18, 19) onto the respective forming unit (7, 8; 16, 17) is performed in areas on both sides of the transporting surface (3).

8. An apparatus comprising:

a transport surface for conveying a group of products in a feed direction;

first and second film feed stations located on opposite sides of the transport surface;

first and second forming units for receiving respective first and second lengths of film from the first and second film feed stations and for forming said first and second lengths of film into respective first and second tubular film sections;

means for moving said first and second forming units in a reciprocal manner transverse to the feed direction to alternately move said first and second forming units into alignment with said transport surface so that said respective first and second tubular film sections are alternately positioned to receive said group of products moving in said feed direction.

9. An apparatus for making packages (1) containing groups (2) of products wrapped with stretch film, the apparatus comprising at least the following:

a transporting surface (3) for conveying the groups (2) of products in a feed direction (A) and presenting a defined front face (FD);

a first pair of film feed stations (4, 5), located on opposite sides of the transporting surface (3);

a first selection carriage (6) comprising at least two units (7, 8) for forming a respective tubular length (9, 10) of film fed by the respective stations (4, 5), and means (11) for driving the first carriage (6) to and fro in a direction transversal to the feed direction (A);

means for cyclically performing the following operations: forming the tubular length of film (9) on a first unit (7) outside the transporting surface (3); and at the same time, positioning the other unit (8) with the respective tubular length of film (10) on it in a sketched configuration at the transporting surface (3) to form a part of the latter so as to enable feeding of the group (2) of products into the tubular length of film (10) and releasing of the tubular length of film (10) over the group (2) of products to form a wrapped package (1);

a station (12), located downstream of the aforementioned stations in the feed direction (A) and designed to turn the incoming package (1) by a defined angle ($\alpha$) as it moves along the transporting surface (3); and, downstream of the station (12), a second pair of film feed stations (13, 14), located on opposite sides of the transporting surface (3);

a second selection carriage (15) comprising at least two units (16, 17) for forming a respective tubular length (18, 19) of film fed by the respective stations (13, 14), and second means (20) for driving the second carriage (15) to and fro in a direction transversal to the feed direction (A);

means for cyclically performing the following operations: forming a third tubular length of film (18) on the third unit (16) outside the transporting surface (3); and at the same time, positioning the fourth unit (17) with the respective fourth tubular length of film (19) on it in a stretched configuration at the transporting surface (3) to form a part of the latter so as to enable feeding of the package (1) of products into the fourth tubular length of film (19) and releasing of the fourth tubular length of film (19) over the package to form a twice-wrapped package (1).

10. The apparatus according to claim 9, wherein each film feed station (4, 5; 13, 14) comprises at least one roll (21) of stretch film and transporting means (22) for positioning a respective length of film (9, 10; 18, 19) at the respective forming unit (7, 8; 16, 17).

11. The apparatus according to claim 9, wherein the first selection carriage (6) comprises a first mobile surface (23) for supporting the at least two units (7, 8) thereof and positioned at an end of first selection carriage (6), and wherein the second selection carriage (15) comprises a second mobile surface (23) for supporting the at least two units (16, 17) thereof and positioned at an end of the second selection carriage (15).

12. An apparatus for making packages (1) containing groups (2) of products wrapped with stretch film, the apparatus comprising:

a transporting surface (3) for conveying a group (2) of products in a feed direction (A), said group of products presenting a front face (FD);

a first pair of film feed stations (4, 5), located on opposite sides of the transporting surface (3);

a first selection carriage (6) comprising at least two units (7, 8) for forming a respective tubular length (9, 10) of film fed by the respective first pair of film feed stations (4, 5), and means (11) for driving the first selection carriage (6) to and fro in a direction transverse to the feed direction (A), wherein said apparatus comprises means for cyclically performing the following operations:

forming the tubular length of film (9) on a first unit (7) outside the transporting surface (3); and at the same time, positioning the other unit (8) with the respective tubular length of film (10) on it in a stretched configuration at the transporting surface (3) so as to enable feeding of the group (2) of products into the tubular length of film (10) and releasing of the tubular length of film (10) over the group (2) of products to form a wrapped package (1).

13. The apparatus according to claim 12, comprising the following, downstream of the first pair of feed stations (4, 5) in the feed direction (A) on the transporting surface (3):

a station (12) for turning the incoming package (1) by a defined angle (α) as it moves along the transporting surface (3); and, downstream of the station (12), a second pair of film feed stations (13, 14), located on opposite sides of the transporting surface (3);

a second selection carriage (15) comprising at least two units (16, 17) for forming a respective tubular length (18, 19) of film fed by the respective stations (13, 14), and second means (20) for driving the second carriage (15) to and fro in a direction transversal to the feed direction (A), wherein said apparatus further comprises means for cyclically performing the following operations:

forming a third tubular length of film (18) on the third unit (16) outside the transporting surface (3); and at the same time, positioning the fourth unit (17) with the respective fourth tubular length of film (19) on it in a stretched configuration at the transporting surface (3) to form a part of the latter so as to enable feeding of the package (1) of products into the fourth tubular length of film (19) and releasing of the fourth tubular length of film (19) over the package to form a twice-wrapped package (1).

14. The apparatus according to claim 13, wherein the turning station (12) comprises two feed surfaces (31, 32) forming a cross on the transporting surface (3) so that the incoming product package (1) is stopped at a defined position and then turned by an angle (α) such that the package (1) is repositioned on the transporting surface (3) and is ready to be overwrapped with another length of film.

15. The apparatus according to claim 13, wherein each film feed station (4, 5: 13, 14) comprises at least one roll (21) of stretch film and transporting means (22) for positioning a respective length of film (9, 10; 18, 19) at the respective forming unit (7, 8; 16,17).

16. The apparatus according to claim 13, wherein the first selection carriage (6) comprises a first mobile surface (23) for supporting the at least two units (7, 8) thereof and positioned at an end of first selection carriage (6), and wherein the second selection carriage (15) comprises a second mobile surface (23) for supporting the at least two units (16, 17) thereof and positioned at an end of the second selection carriage (15).

17. The apparatus according to claim 13, wherein each of the at least two units (7, 8) of the first selection carriage (6) and each of the at least two units (16, 17) of the second selection carriage (15) comprises at least two pairs (25, 26) of horizontal arms around which the respective film length (9, 10: 18, 19) is wound; at least one pair of arms (25) being mobile towards and away from the other pair of arms (26) so as to stretch the respective length of film (9, 10; 18, 19) and then release the tubular film length (9, 10; 18, 19) over the respective group (2) of products.

18. The apparatus according to claim 12, wherein each film feed station (4, 5; 13, 14) comprises at least one roll (21) of stretch film and transporting means (22) for positioning a respective length of film (9, 10; 18, 19) at the respective forming unit (7, 8; 16, 17).

19. The apparatus according to claim 12, wherein each carriage (6, 15) comprises a mobile surface (23) for supporting the respective pair of units (7, 8; 16, 17) for forming the length (9, 10; 18, 19) and positioned at the respective end of the corresponding carriage (6, 15); the surface (23) being slidably mounted on at least one guide (24) located under the surface (23) in such a way as to enable one of the units (7, 8; 16, 17) to be moved close to the respective feed station (4, 5; 13, 14) while the other unit (7, 8; 16, 17) is positioned at the transporting surface (3), and vice versa.

20. The apparatus according to claim 19, wherein each carriage (6, 15) has at least two areas (27, 28) where the respective group (2) of products is supported and passes into the respective tubular film length (9, 10; 18, 19), each such area consisting of a double plurality of superposed, counterrotating rollers (29, 30) designed to simultaneously feed out in a single feed direction (A) the product group (2) or package (1) and the respective film length (9, 10; 18, 19) wound around the group (2) or package (1) itself.

21. The apparatus according to claim 12, wherein each unit (7, 8; 16, 17) for forming the tubular length of film (9, 10; 18, 19) comprises at least two pairs (25, 26) of horizontal arms around which the respective film length (9, 10; 18, 19) is wound; at least one pair of arms (25) being mobile towards and away from the respective fixed arm (26) so as to stretch the respective length of film (9, 10; 18, 19) and then release the tubular film length (9, 10; 18, 19) over the respective group (2) of products.

* * * * *